US007439461B2

(12) United States Patent
Sawada et al.

(10) Patent No.: US 7,439,461 B2
(45) Date of Patent: Oct. 21, 2008

(54) NEUTRAL POSITION RETURNING MECHANISM AND INPUT DEVICE USING THE SAME

(75) Inventors: Masaki Sawada, Osaka (JP); Tamotsu Yamamoto, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 133 days.

(21) Appl. No.: 11/250,286

(22) Filed: Oct. 14, 2005

(65) Prior Publication Data

US 2006/0117894 A1 Jun. 8, 2006

(30) Foreign Application Priority Data

Oct. 20, 2004 (JP) ..... 2004-305479

(51) Int. Cl.
*H01H 19/00* (2006.01)
*H01H 21/00* (2006.01)

(52) U.S. Cl. ..... 200/6 A; 200/4; 200/6 R

(58) Field of Classification Search ..... 200/6 A
See application file for complete search history.

(56) References Cited

U.S. PATENT DOCUMENTS

| | | | | |
|---|---|---|---|---|
| 5,140,313 | A * | 8/1992 | Wen | 345/161 |
| 5,252,952 | A | 10/1993 | Frank et al. | |
| 6,215,478 | B1 | 4/2001 | Yeh et al. | |
| 6,573,464 | B2 * | 6/2003 | Yen | 200/6 A |
| 6,667,733 | B2 | 12/2003 | Miyoshi | |
| 6,864,679 | B2 | 3/2005 | Yokoji et al. | |
| 7,148,880 | B2 * | 12/2006 | Magara | 345/161 |
| 7,158,115 | B2 * | 1/2007 | Harley et al. | 345/157 |
| 2001/0007449 | A1 | 7/2001 | Kobachi | |

FOREIGN PATENT DOCUMENTS

| | | |
|---|---|---|
| CN | 1317737 | 10/2001 |
| CN | 1447216 | 10/2003 |
| DE | 807 740 C | 7/1951 |
| FR | 2 308 226 A | 11/1976 |
| JP | 2002-108473 A | 4/2002 |
| JP | 2003-173214 A | 6/2003 |
| WO | WO 2005/055038 A | 6/2005 |

OTHER PUBLICATIONS

European Search Report for Application No. EP 05 10 9735, dated Feb. 16, 2006.

* cited by examiner

*Primary Examiner*—Elvin Enad
*Assistant Examiner*—Lheiren Mae A Anglo
(74) *Attorney, Agent, or Firm*—RatnerPrestia

(57) ABSTRACT

A neutral position returning mechanism includes an actuator, a spring member including plural elastic extending portions having spiral shapes identical to each other, and a case holding the spring member as to apply a stress to the elastic extending portions. The elastic extending portions extend spirally in a predetermined direction on a predetermined surface from the actuator as a center of each of the spiral shapes. The elastic extending portions extend from the actuator by equal angular intervals about the actuator. The neutral position returning mechanism provides an input device having a low profile.

15 Claims, 9 Drawing Sheets

NEUTRAL POSITION RETURNING MECHANISM AND INPUT DEVICE USING THE SAME

FIELD OF THE INVENTION

The present invention relates to a neutral position returning mechanism for causing an actuator to return to its neutral position and an input device using the mechanism.

BACKGROUND OF THE INVENTION

Electronic apparatuses include various input devices. Game machines are actuated with the tiling of joy sticks.

FIG. 9 is a perspective view of a conventional input device disclosed in Japanese Patent Laid-Open Publication No. 2003-173214, and FIG. 10 is an top view of the device. Rotary input devices 2, such as variable resistors, are mounted on outer sides of case 1 of a substantially-cubic shape adjacent to each other, respectively. Input devices 2 have operating shafts extending towards the center of the case 1. Rotatable members 3 are accommodated in case 1 and extend perpendicularly to each other. Rotatable members 3 couple to the operating shafts of the rotary input devices 2 to rotate together with the shafts, respectively. The rotatable member 3 has center hole 3A therein into which bar actuator 4 is inserted. The rotatable members 3 are held at their positions with urging members so that actuator 4 is at its neutral position orthogonal to the rotatable members 3 when not being actuated.

When actuator 4 is actuated or tilted, the rotatable members 3 rotate according to their tilting angle. This allows the operating shafts of the rotary input devices 2 to rotate for producing predetermined outputs.

When actuator 4 stops tilting, the urging members cause the rotatable members 3 to return back to their original positions. Then, actuator 4 returns back to the neutral position while being guided in center holes 3A of the rotatable members 3.

As electronic devices have recently been developed for various purposes, input devices are required to be thin and to return easily to neutral positions after tilting or other controlling operation. However, in the conventional input device, actuator 4 returns back to the neutral position for a tilting operation. Case 1 has a height determined by the diameters of rotary input devices 2 mounted on the outer sides of case 1, thus preventing the input device from having a low profile.

SUMMARY OF THE INVENTION

A neutral position returning mechanism includes an actuator, a spring member including plural elastic extending portions having spiral shapes identical to each other, and a case holding the spring member as to apply a stress to the elastic extending portions. The elastic extending portions extend spirally in a predetermined direction on a predetermined surface from the actuator as a center of each of the spiral shapes. The elastic extending portions extend from the actuator by equal angular intervals about the actuator.

The neutral position returning mechanism provides an input device having a low profile.

DESCRIPTION OF THE PREFERRED EMBODIMENTS

Exemplary Embodiment 1

Figure 1:
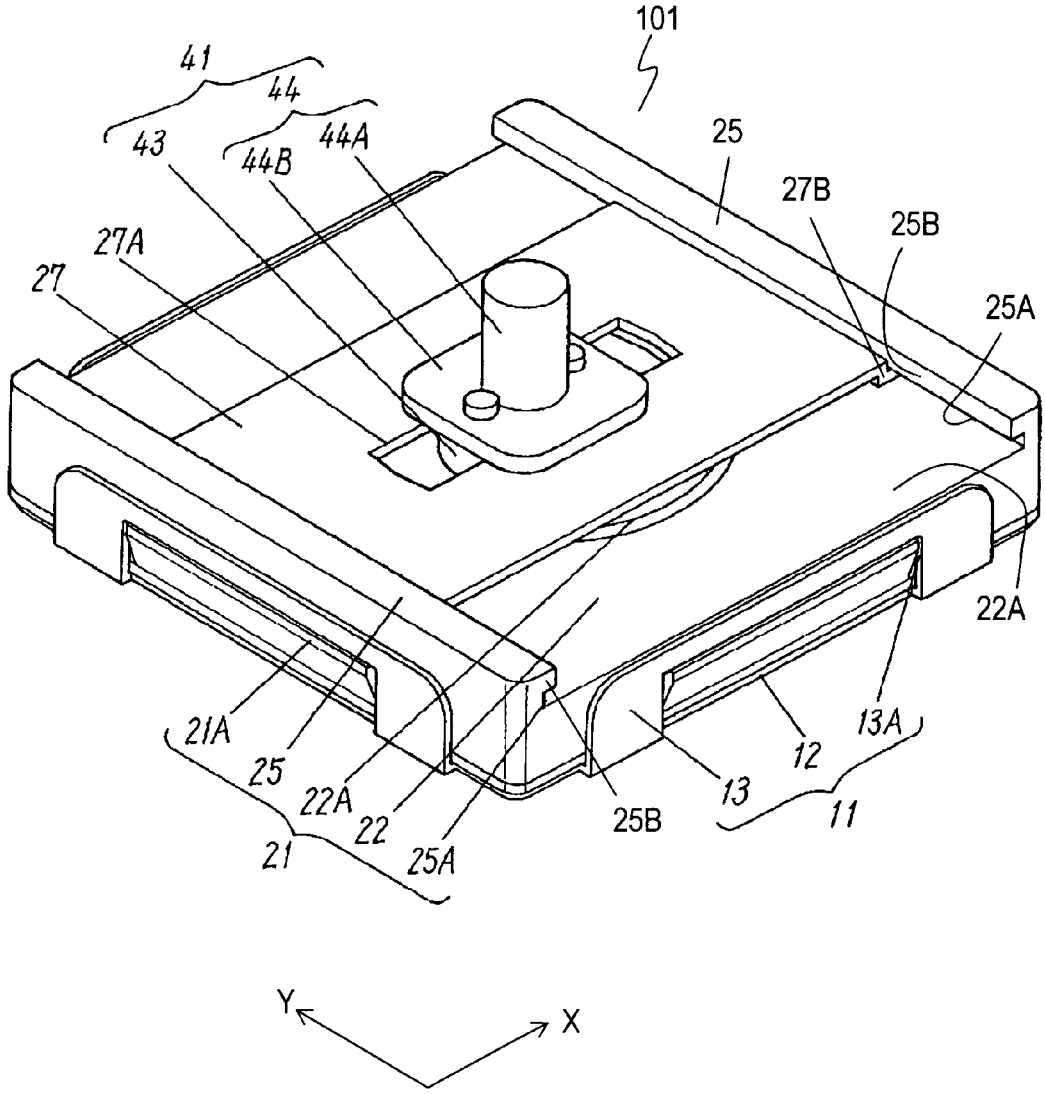
FIG. 1 is a perspective view of an input device using a neutral position returning mechanism according to Exemplary Embodiment 1 of the present invention.
Figure 2:
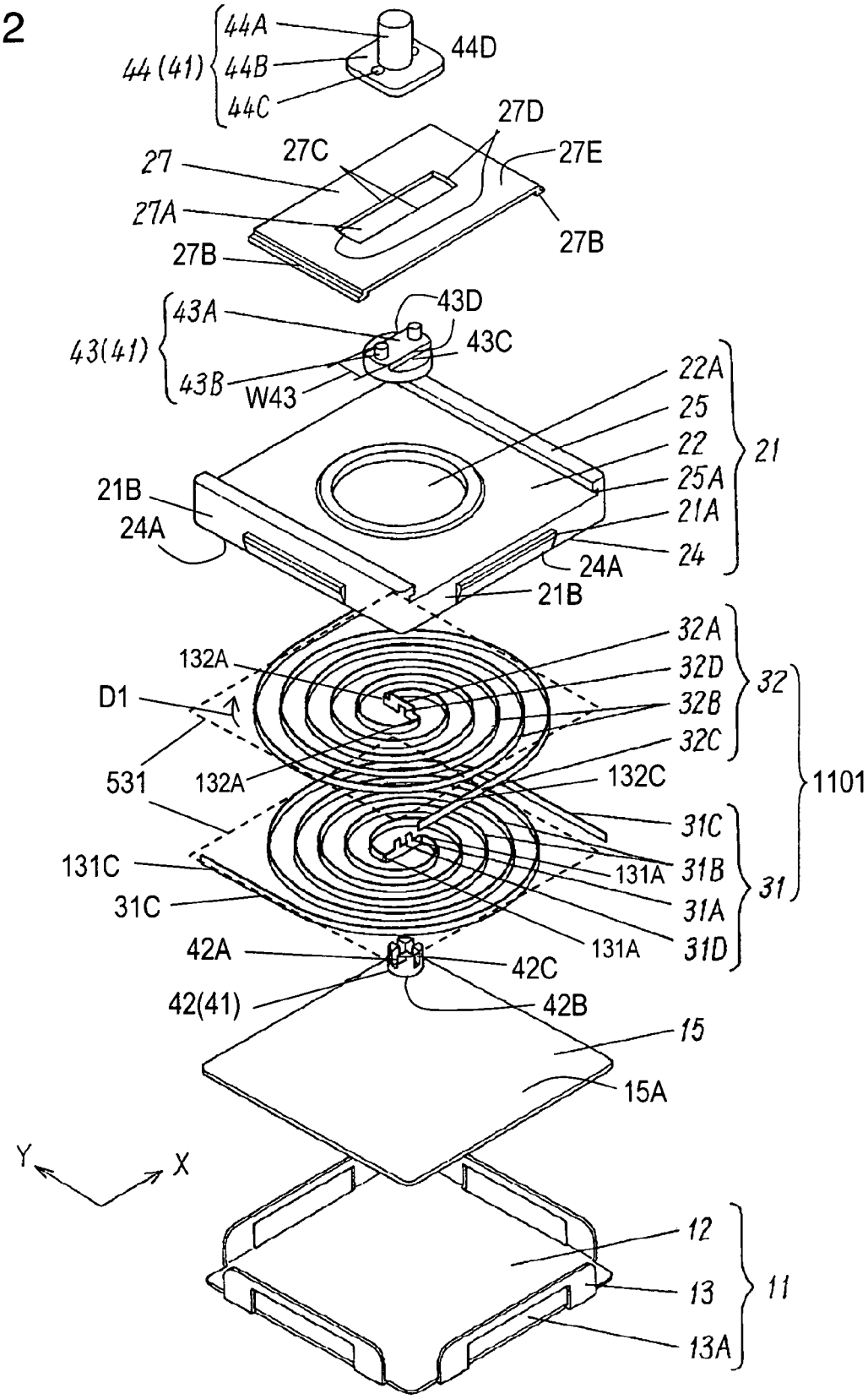
FIG. 2 is an exploded perspective view of the input device according to Embodiment 1.
Figure 3:
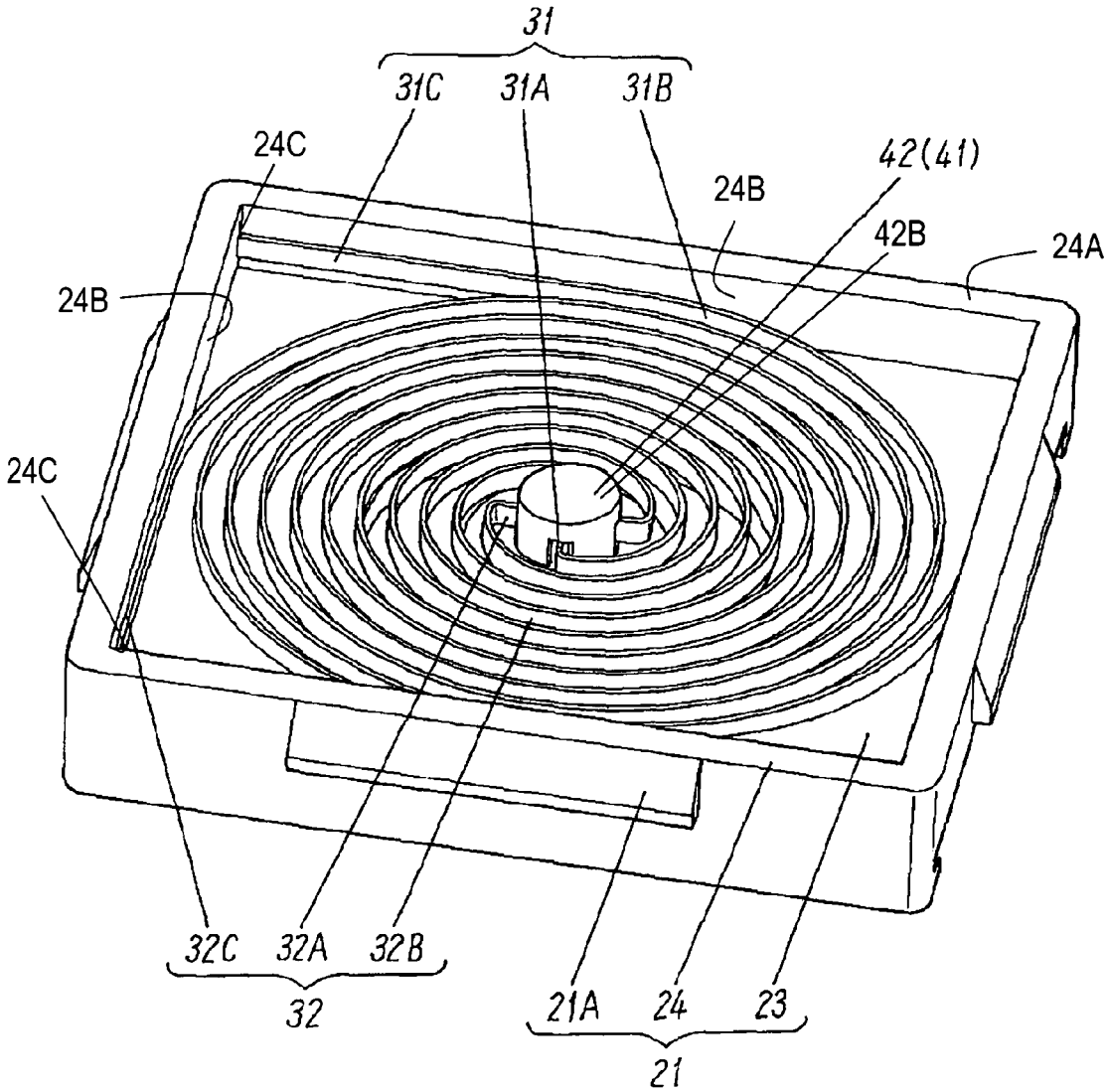
FIG. 3 is a perspective view of the input device according to Embodiment 1.

FIG. 1 is a perspective view of input device 101 including a neutral position returning mechanism 1101 according to Exemplary Embodiment 1 of the present invention. FIGS. 2 and 3 are an exploded perspective view and a perspective view of the input device 101, respectively. Lower cover 11 made of metallic sheet has bottom 12 having a substantially-square shape and has retainer 13 folded upwardly from each of four sides of the bottom 12, each retainer having opening 13A provided therein. Coordinate detector 15 is provided on bottom 12.

Coordinate detector 15 is a touch panel which includes flexible insulating sheet 15A, another insulating sheet spaced by a distance from flexible insulating sheet 15A, and resistive films made of resistive material, such as carbon, mounted on facing sides of the insulating sheets, respectively. Upon being depressed by an urging force, flexible insulating sheet 15A deflects downwardly, causing the resistive films to contact each other. Then, a voltage is supplied to one resistive film through a flexible circuit board, and a voltage at a position where the resistive films contact is taken from the other resistive film, thus allowing coordinates of the deflecting position where the urging force has been applied to be detected.

Insulating resin case 21 is provided on bottom 12 of lower cover 11. Case 21 has projections 21A on four sides 21B thereof, and projections 21A are engaged with openings 13A of retainers 13, respectively, thus coupling jointing case 31 with lower cover 11. Lid 22 of case 21 forming an upper surface of case 21 has round opening 22A provided substantially at the center thereof Case 21 has outer walls 24 forming four sides 21B under lid 22 and has square recess 23 formed in its lower side. Lower ends 24A of outer walls 24 contact bottom 12 of lower cover 11. Coordinate detector 15 is positioned in recess 23.

Neutral position returning mechanism 1101 is located in recess 23 of case 21 on coordinate detector 15. Neutral position returning mechanism 1101 includes spring members 31 and 32.

Spring member 31 is made of linear strip spring having a predetermined width. The strip spring is placed while the width extending vertically and arranged to have a spiral shape. Spring member 31 includes straight portion 31A having both ends 131A, two elastic extending portions 31B extending spirally in direction D1 from ends 131A, respectively, and linear portions 31C linearly extending from elastic extending portions 31B, respectively. Two extending portions 31B are wound in spiral shapes by pitches identical to each other from ends 131A of straight portion 31A as centers, respectively. That is, two elastic extending portions 31B extend to have shapes identical to each other. Spring member 31 has a simple structure which can be formed by wind the strip spring, being inexpensive.

Linear portion 31C of the spring member 31 has outer side 131C which contacts the inner side of outer wall 24 forming recess 23 of case 21 to hold outer side 131C. Outer wall 24 urges elastic extending portions 31B of spring member 31 inward and slightly as to apply a stress to elastic extending portions 31B. Each of linear portions 31C contacts a portion of outer wall 24 from center 24B at the center of each side of recess 23 of case 21 to corner 24C at the corner of recess 23 of case 21. This arrangement positions spring member 31 securely in recess 23. Straight portion 31A of spring member 31 has engaging portion 31D provided at the center of straight portion 31A.

Spring member 32 is made of linear leaf spring material having a predetermined width similarly to spring member 31. The spring material is placed while the width extending vertically and arranged to have a spiral shape. Spring member 32 includes straight portion 32A having both ends 132A, two elastic extending portions 32B extending spirally in direction D1 from ends 132A, respectively, and linear portions 32C linearly extending from elastic extending portions 32B, respectively. Elastic extending portions 32B extend in shapes identical to those of elastic extending portions 31B, and wound by pitches identical to those of elastic extending portions 31B.

Spring member 32, similarly to spring member 31, is positioned and secured in recess 23 of the case 21. More particularly, outer sides 132C of linear portions 32C of spring member 32 contact an inner side of recess 23 of outer wall 24 of the case 21, being held at the inner side of the recess. Outer wall 24 urges inward elastic extending portions 32B of spring member 32 so as to apply a stress to elastic extending portions 32B. Each of linear portions 32C contacts outer wall 24 from center 24B at the center of each side at recess 23 of case 21 to corner 24C at recess 23 of case 21.

Engaging portion 31D engages with engaging portion 32D perpendicularly to portion 32D as to join spring member 31 to spring member 32.

As described above, spring members 31 and 32 have the shapes substantially identical to each other. Spring members 31 and 32 are held in square recess 23 of case 21 while straight portions 31A and 32A are joined perpendicularly to each other, and elastic extending portions 31B and 32B having the spiral shapes are alternately located on predetermined surface 531 which is a plane.

Straight portions 31A and 32A joined with each other are linked with actuator 41 which includes lower member 42, intermediate member 43, and operating member 44. Four elastic extending portions 31B and 32B having the spiral shapes extend from actuator 41 on predetermined surface 531 by equal angular intervals, i.e., 90 degrees about actuator 41 as a center of each of the spiral shapes. Lower member 42 has lower side 42B thereof having a substantially semi-spherical shape and located over flexible insulating sheet 15A of coordinate detector 15. Lower side 42B may be spaced from or placed directly on flexible insulating sheet 15A.

Lower member 42 of actuator 41 has upper side 42C thereof provided with cross slot 42A therein. Cross slot 42A accepts straight portions 31A and 32A which have been joined perpendicularly to each other. Intermediate member 43 having a substantially round shape is put from above on cross slot 42A and joined with lower member 42 so that straight portions 31A and 32A are sandwiched between intermediate member 43 and lower member 42 of actuator 41.

Intermediate member 43 has an upper side 43C thereof provided with restrictive projection 43A which has sides 43D parallel to each other spaced by width W43. Sides 43D of restrictive projection 43A extend in parallel to one side of coordinate detector 15 having a rectangular shape, a touch panel. Intermediate member 43 is positioned in round opening 22A in lid 22 of case 21 while restrictive projection 43A is positioned above lid 22.

As shown in FIGS. 1 and 2, an X-direction represents the direction parallel with sides 43D of restrictive projection 43A and flexible insulating sheet 15A of coordinate detector 15, and a Y-direction represents the direction perpendicular to sides 43D of restrictive projection 43A.

Case 21 has motion regulators 25 on upper surface 22A of lid 22. Motion regulators 25 extend in the Y-direction to position round opening 22A between them. Motion regulators 25 have side slots 25A provided in respective sides 25B thereof facing each other. Side slots 25A in sides 25B of regulators 25 extend in the Y-direction, having constant heights.

Side edges 27B of movable member 27 are inserted in side slots 25A of motion regulators, respectively, allowing movable member 27 having a substantially rectangular shape to slide only in the Y-direction. Movable member 27 has rectangular support opening 27A provided in the center thereof.

Restrictive projection 43A of intermediate member 43 is engaged in support opening 27A in movable member 27 from beneath it. Support opening 27A has long sides 27C extending in the X-direction and short sides 27D extending in the Y-direction. Short side 27D is slightly longer than width W43 between sides 43C of restrictive projections 43A.

Operating member 44 is securely joined to restrictive projection 43A of intermediate member 43 and projects outward from support opening 27A. Operating member 44 includes upper stick portion 44A and flange portion 44B. Upper stick portion 44A is actuated by a user. Flange portion 44B has a substantially square shape and located beneath stick portion 44A. Each side of flange portion 44B is longer than short side 27D of support opening 27A. Flange portion 44B has lower side 44D thereof extending in flat and facing movable member 27. Flange portion 44B has holes 44C provided therein.

Intermediate member 43 has cylindrical projections 43B projecting from restrictive projection 43A. Cylindrical projections 43B are inserted into holes 44C provided in flange portion 44B of operating member 44, respectively. Intermediate member 43 is coupled to operating member 44 with cylindrical projections 43B which are inserted into holes 44C and crushed at the top. This arrangement positions movable member 27 between upper side 43C of restrictive projection 43A of intermediate member 43 and lower side 44D of flange portion 44B of operating member 44. A predetermined gap is provided between lower side 44D of flange portion 44B and upper side 27E of movable member 27.

Spring members 31 and 32 having the shapes identical to each other are held in recess 43 in case 21 while receiving stresses, hence causing straight portions 31A and 32A to be held between intermediate member 43 and lower member 42, and to be balanced at neutral positions in both the X-direction and the Y-direction. Spring members 31 and 32 urged by their spring-back forces prevent actuator 41 from moving with a small force. In other words, even when stick portion 44A of operating member 44 is unintentionally pressed by a finger, actuator 41 does not move in both the X-direction and the Y-direction as well as in upward and downward, vertical directions perpendicular to the X-direction and the Y-direction.

An operation of input device 101 will be described below.

Stick portion 44A of operating member 44 is pressed slightly downward, and then, straight portions 31A and 32A of spring members 31 and 32 provided between intermediate member 43 and lower member 42 of actuator 41 shifts down to press lower side 42B of lower member 42 against flexible insulating sheet 15A of coordinate detector 15, the touch panel. This operation causes elastic extending portions 31B and 32B of spring members 31 and 32 to form their spiral shapes from on predetermined surface 531 and to on a concave surface having a bottom at straight portions 31A and 32A. The spring forces of spring members 31 and 32 are determined so that linear portions 31C and 32C of spring members 31 and 32 are not displaced in case 21 even when elastic extending portions 31B and 32B are located on the concave surface. Then, coordinate detector generates a voltage corresponding to a point on flexible insulating sheet 15A pressed with lower side 42B of lower member 42, thus detecting coordinate of the neutral position.

While insulating sheet 15A of coordinate detector 15 is pressed with lower side 42B of lower member 42, stick portion 44A of operating member 44 of actuator 41 is slid to a desired point in the X-direction. Actuator 41 shifts to the desired point in the X-direction while restrictive projection 43A of intermediate member 43 is guided at both sides 43D in and along long sides 27C of support opening 27A in movable member 27, and elastic extending portions 31B and 32B of spring members 31 and 32 are further urged.

Then, the coordinate of the desired point pressed with lower side 42B of lower member 42 is detected by coordinate detector 15. The spring forces of spring members 31 and 32 are determined as to allow linear portions 31C and 32C of spring members 31 and 32 not to displaced in case 21.

When the sliding movement of actuator 41 to the desired point in the X-direction is canceled, elastic extending portions 31B and 32B of spring members 31 and 32 return back to their original position due to their spring-back force. This causes actuator 41 to return back to the neutral position while restrictive projection 43A is guided at both sides 43D along long sides 27C of support opening 27A in movable member 27. Simultaneously, lower side 42B of lower member 42 of actuator 41 departs from coordinate detector 15 and returns back to its original position.

While coordinate detector 15 is pressed with lower side 42B of lower member 42, stick portion 44A of operating member 44 of actuator 41 is slid to a desired point in the Y-direction. Simultaneously, one side 43D of restrictive projection 43A of intermediate member 43 presses long side 27C of support opening 27A of movable member 27. This pressing causes movable member 27 to move in the Y-direction while being guided at both sides 27B in side slots 25A of case 21. Simultaneously, elastic extending portions 31B and 32B of spring members 31 and 32 are biased according to the movement. Similarly to the movement in the X-direction, coordinate detector 15 generates a voltage corresponding to the desired point on flexible insulating sheet 15A pressed with lower side 42B of lower member 42, thus detecting the coordinate of the desired point.

When the sliding movement of actuator 41 to the desired point in the Y-direction is canceled, elastic extending portions 31B and 32B of spring members 31 and 32 return back to their original position due to their 5 spring-back force. This causes actuator 41 to return back to the neutral position while movable member 17 is guided at the both sides 17B along side slots 25A of motion regulators 25 of case 21. Simultaneously, lower side 42B of lower member 42 of actuator 41 departs from coordinate detector 15 and returns back to its original position.

In the sliding movement in the Y-direction, elastic extending portions 31B and 32B of spring members 31 and 32 are biased from on predetermined surface 531 to on a concave surface having a bottom at straight portions 31A and 32A.

Input device 101 according to this embodiment allows the sliding movement in both the X-direction and the Y-direction. More particularly, actuator 41 may be arbitrarily slid in all directions throughout the plane, and the coordinate of the position of the actuator can be detected by coordinate detector 15 detecting the voltage induced at the position of actuator 41. When the sliding movement of actuator 41 is canceled and its control is released, elastic extending portions 31B and 32B of spring members 31 and 32 return back to their original state due to their spring-back force, thus allowing actuator 41 to return back to the neutral position.

In the sliding movement in both the X-direction and the Y-direction, actuator 41 is slid while resisting against a combined spring force of spring members 31 and 32 which have the shapes substantially identical to each other and which are coupled perpendicularly to each other. This arrangement allows actuator 41 to move with a uniform operating force in all directions.

Round opening 22A provided in lid 22 of case 21 contacts intermediate member 43 of actuator 41, thus limiting the movement of actuator 41.

Spring members 31 and 32 of neutral position returning mechanism 1101 according to Embodiment 1 ordinarily extend on predetermined surface 531 which is the plane. Thus, neural position returning mechanism 1101 allows input device 101 to be thin.

Neutral position returning mechanism 1101 according to Embodiment 1 includes four elastic extending portions 31B and 32B of spring members 31 and 32. At least two of the elastic extending portions having spiral shapes, that is, only spring member 31 can provide the same effects without spring member 32. Spring member 31 according to Embodiment 1 includes plural elastic extending portions 31B. Plural elastic extending portions 31B extend spirally in the predetermined direction on the predetermined surface from the actuator as a center of each of the spiral shapes. For example, if the number of the plural elastic extending portions is two, the elastic extending portions extends from the actuator by angular intervals of 180 degrees. If the number of the elastic extending portions is three, the elastic extending portions extend from the actuator by angular intervals of 120 degrees.

Figure 4:
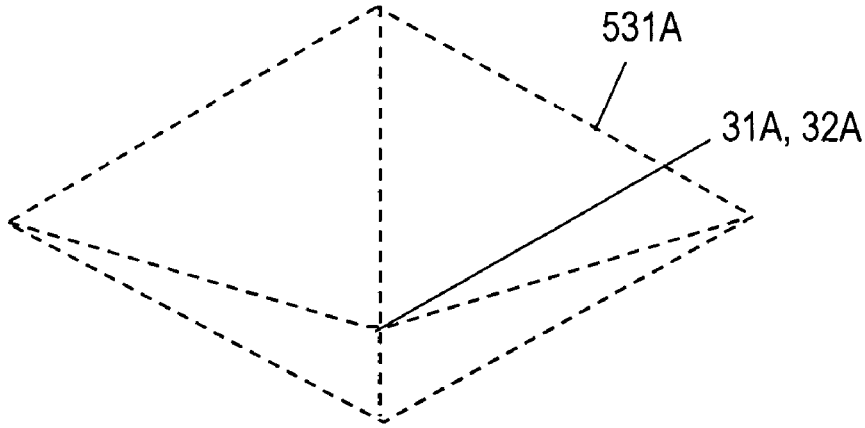
FIG. 4 shows a concave surface on which elastic extending portions of the neutral position returning mechanism are arranged according to Embodiment 1.

While actuator 41 is not activated, spring members 31 and 32 of neutral position returning mechanism 1101 are located on predetermined surface 531 which is the plane. Predetermined surface 531 of neutral position returning mechanism 1101 may be concave surface 531A (Shown in FIG. 4) having a bottom at straight potions 31A and 31B of elastic extending portions 31B and 32B.

Input device 101 according to Embodiment 1 includes the touch panel as coordinate detector 15. The touch panel is inexpensive, thus allowing input device 101 to be inexpensive.

Figure 5:
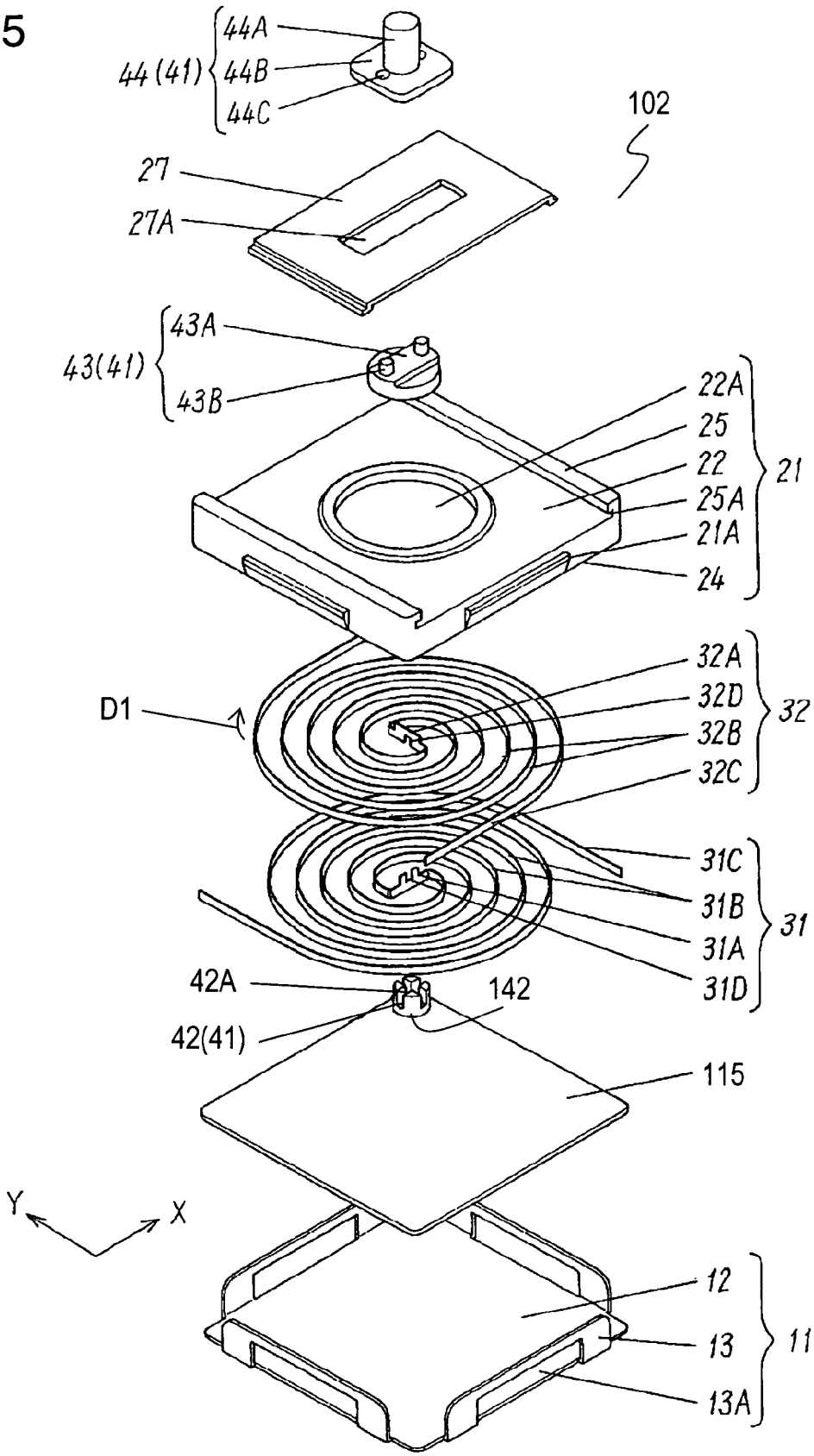
FIG. 5 is an exploded perspective view of another input device according to Embodiment 1.

FIG. 5 is an exploded perspective view of another input device 102 according to Embodiment 1. Input device 102 includes magnetic plate 115 generating magnetic field different from positions thereon as coordinate detector 15 instead of the touch panel shown in FIGS. 1 to 3. A magnetic detector 142 on the lower side of lower member 42 of actuator 41 faces coordinate detector 115. The other arrangement of input device 102 is identical to that of input device 101. Magnetic detector 142 detects the position of actuator 41 without touching coordinate detector 115, hence increasing an operating life of coordinate detector 115 and input device 102.

Exemplary Embodiment 2

Figure 6:
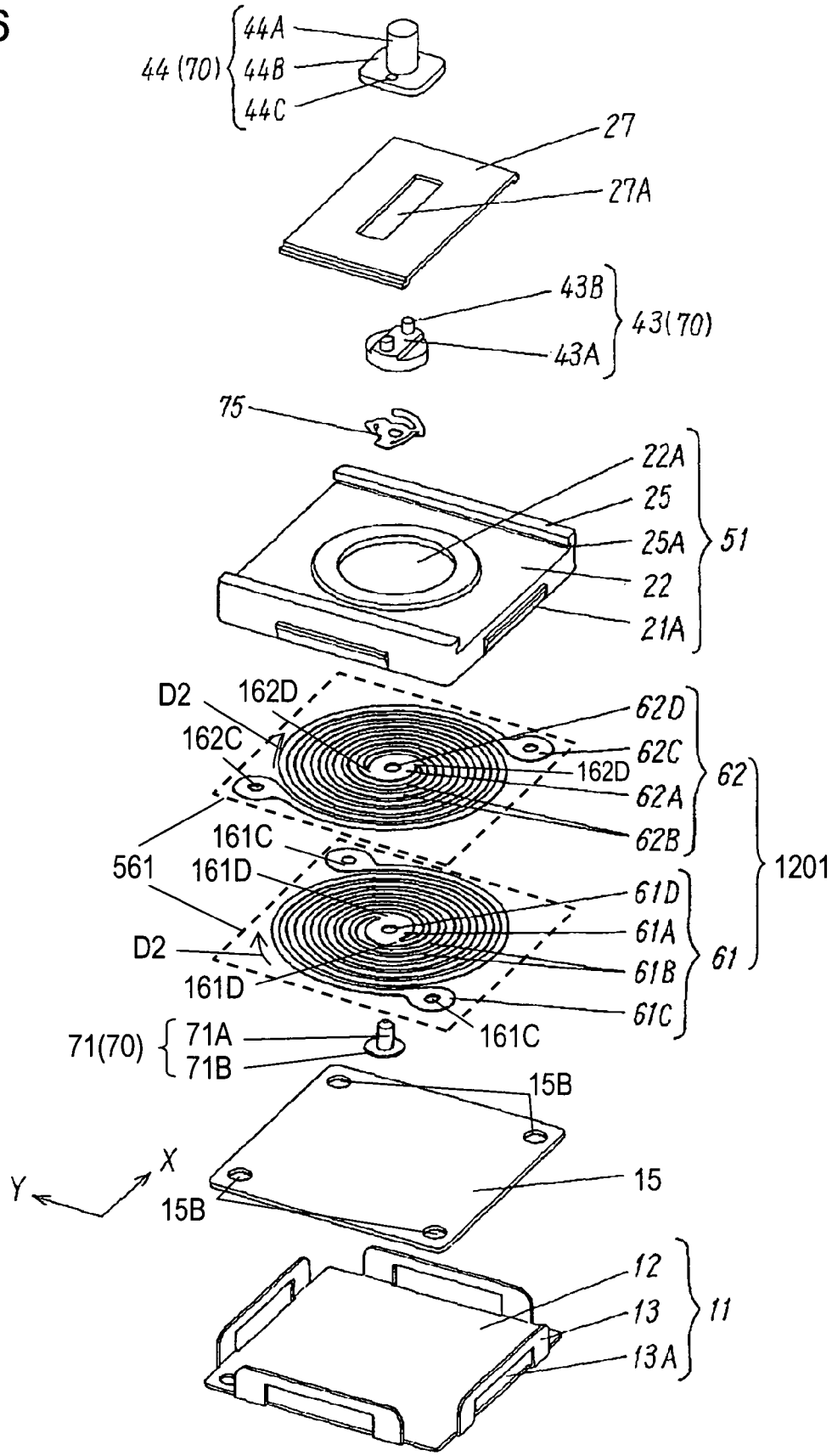
FIG. 6 is an exploded perspective view of an input device using a neutral position returning mechanism according to Exemplary Embodiment 2 of the invention.
Figure 7:
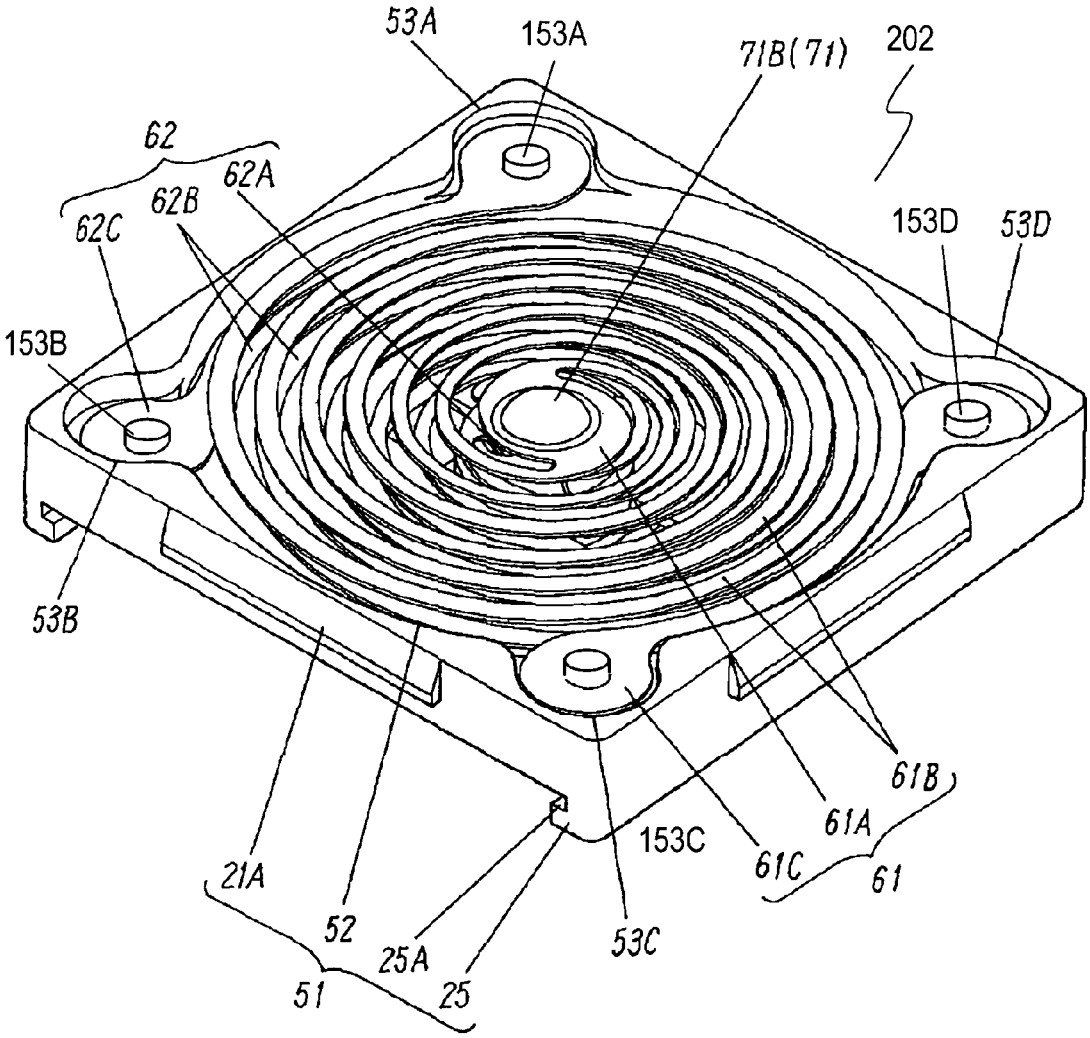
FIG. 7 is a perspective view of the input device according to Embodiment 2.

FIG. 6 is an exploded perspective view of input device 201 including neutral position returning mechanism 1201 according to Exemplary Embodiment 2 of the present invention. FIG. 7 is a perspective view of input device 201. Components identical to those of embodiment 1 are denoted by the same reference numerals and will be explained in no more detail. Input device 201 includes coordinate detector 15 of a touch panel, case 51, and lower cover 11.

Case 51, similarly to case 21 of Embodiment 1, includes lid 22 having round opening 22A provided therein and motion regulator 25. Case 51, differently from case 21 of Embodiment, has round recess 52 provided therein coaxially with round opening 22A at the lower side of lid 22.

Case 51 has recesses 53A to 53D provided in four corners of the lower side thereof adjacent to round recess 52, respectively. Recesses 53A and 53C located diagonally to each other have the same depths while recesses 53B and 53D located diagonally to each other have the same depths. The depth of recess 53A is different from the depth of the recess 53B. Projections 153A to 153D are provided at corner recesses 53A to 53D, respectively.

Neutral position returning mechanism 1201 includes two spring members 61 and 62 accommodated in round recess 52 of case 51. Each of spring members 61 and 62 is made of sheet material arranged in parallel with insulating sheet 15A of coordinate detector 15.

Spring member 61 includes round portion 61A, two elastic extending portions 61B having spiral shapes extending spirally in direction D2 from round portion 61A, and round portions 61C connected with elastic extending portions 61B, respectively. Two elastic extending portions 61B extend spirally at equal pitches on predetermined surface 561 which is a plane from positions 161A round portion 61A symmetrically to each other. That is, two elastic extending portions 61B extend to have shapes identical to each other. Elastic extending portions 61B are arranged alternately on predetermined surface 561. Round portion 61C has hole 161C provided therein. Round portion 61A has hole 61D provided in the center thereof.

Spring member 62 has the shape identical to that of spring member 61, and includes round portion 62A, two elastic extending portions 62B having spiral shapes extending spirally in direction D2 from round portion 62A, and round portions 62C connected to elastic extending portions 62B, respectively. Two elastic extending portions 62B extend spirally at equal pitches on predetermined surface 561 which is the plane from positions 162A round portion 62A symmetrically to each other. That is, two elastic extending portions 62B extend to have shapes identical to each other. Elastic extending portions 62B are arranged alternately on predetermined surface 561. Round portions 62C have holes 162C provided therein, respectively. Round portion 62A has hole 62D provided in the center thereof. The centers of the spiral shapes of elastic extending portions 61B and 62 are round portions 61C and 62C, respectively.

Spring member 61 is placed on spring member 62, as shown in FIG. 7, so that elastic extending portions 61B and 62B extend orthogonal to each other, and round portions 61A and 62A precisely overlapped each other as well as the two round portions 61C and 62C precisely overlapped each other. That is, the line extending between respective positions 161A of round portions 61A of spring member 61 is arranged perpendicularly to the line extending between respective positions 162A of round portions 62A of spring member 62. In other words, two positions 161A are located symmetrically to each other about the center of the spiral shape of, elastic extending portions 61B while two positions 162A are located symmetrically to each other about the center of the spiral shape of elastic extending portions 62B. Two positions 161A and two positions 162B are located at angular intervals of 90 degrees about the centers of the spiral shapes of elastic extending portions 61B and elastic extending portions 62B. That is, elastic extending portions 62B and 61B extend from round portions 61A and 62A on predetermined surface 561 by equal angular intervals, i.e., 90 degrees about round portions 61A and 62A as centers.

Round portion 61A and elastic extending portions 61B of spring member 61 are accommodated in round recess 52, and round portions 61C are located in recesses 53A and 53C of case 51, respectively. That is, holes 161C of round portions 61C are engaged with projections 151A and 151C provided in recesses 53A and 53C, respectively. Projections 151A and 151C of case 51 extending through holes 161C of round portions 61C are crushed at the top to increase their diameters, thus mounting spring member 61 fixedly to case 51. At this moment, elastic extending portions 61B are held and pulled to depart from round portion 61A, thus applying a stress to spring member 61.

Spring member 62 is arranged between spring member 61 and coordinate detector 15 and extends perpendicularly to spring member 61. Round portions 62A and elastic extending portions 62B of spring member 62 are accommodated in round recess 52, and round portions 62C are located in recesses 53B and 53D of case 51, respectively. Projections 151B and 151D of case 51 extending through holes 162C of round portions 62C are crushed at the top to increase their diameters, thus mounting spring member 62 fixedly to case 51. At this moment, elastic extending portions 62B are held and pulled to depart from round portion 62A. Spring members 61 and 62 are pulled to receive stresses equal to each other in case 51. Projections 151B and 151D of case 51 are inserted in holes 162C of round portions 62C of spring member 62. Then, projections 151B and 151D are inserted in jointing holes 15B of coordinate detector 15, thus fixing coordinate detector 15 to case 51 together with spring member 62.

round portions 61A and 62A overlapped each other by overlapping spring member 61 on spring member 62 are then coupled with actuator 70. Actuator 70 includes operating member 44, intermediate member 43, and lower member 71.

Lower member 71 includes flange portion 71B and projection 71A extending upward from flange portion 71B. Projection 71A is inserted from below into holes 61D and 62D at the center of spring members 61 and 62 and joined to intermediate member 43. Spring members 61 and 62 are positioned between intermediate member 43 and flange portion 71B of lower member 71. Spring 75 is provided between intermediate member 43 and spring member 62. Spring 75 presses spring members 61 and 62 against flange portion 71B for preventing slipping or dislocation between spring members 61 and 62. Flange portion 71B of lower member 71 has a lower side thereof having a substantially semi-spherical shape to face coordinate detector 15, similarly to lower side 142 of lower member 42 of Embodiment 1.

Case 51 includes motion regulators 25 which are identical to those of input device 101 of Embodiment 1 for guiding movable member 27 and intermediate member 43.

An operation of input device 201 including neutral position returning mechanism 1201 according to Embodiment 2 will be described below.

In an ordinary state that the device is not activated, elastic extending portions 61B and 62B of spring members 61 and 62 are slightly pulled and held in case 51. Stresses in elastic extending portions 61B and 62B stabilize actuator 70 to position stick portion 44A of operating member 44 at a neutral position to prevent displacement due to an unintentional movement of stick portion 44A triggered by a finger.

When stick portion 44A of operating member 44 is depressed, spring members 61 and 62 are displaced from predetermined surface 561 which is the plane, and are positioned on a concave surface having a bottom at the center of each of the spiral shapes. Then, actuator 70 is slid in parallel with insulating sheet 15A of coordinate detector 15, and accordingly, elastic extending portions 61B and 62B deform. Coordinate detector 15, similarly to input device 101 of embodiment 1, generates a voltage, information about the position of actuator 70, thus detecting the coordinates of the position.

When the sliding movement of actuator 70 is canceled, elastic extending portions 61B and 62B return back to their original state due to their spring-back force, thus causing actuator 70 to shift to the neutral position. Simultaneously, lower side 171 of lower member 71 of actuator 70 is removed from coordinate detector 15 and returns to the neutral position.

Neutral position returning mechanism 1201 according to Embodiment 2 includes spring members 61 and 62 made of planer sheet elastic material, and accordingly is thinner than neutral position returning mechanism 1101 according to Embodiment 1. Further, the number of processes of assembling the spring members 61 and 62 is reduced.

Spring members 61 and 62 having the shapes identical to each other can be manufactured precisely and inexpensively by punching a metal elastic sheet material.

Neutral point returning mechanism 1201 according to Embodiment 2 includes for elastic extending portions 61B and 62B of spring members 61 and 62. At least two elastic extending portions having the spiral shape can provide the same effects. That is, only spring member 61 without spring member 62 can provides the same effects. When actuator 70 is not activated, spring members 61 and 62 of neutral position returning mechanism 1201 are located on predetermined surface 561 which is the plane.

Input device 201 according to Embodiment 2 includes the touch panel as coordinate detector 15. The touch panel is inexpensive, thus making input device 201 inexpensive.

Figure 8:
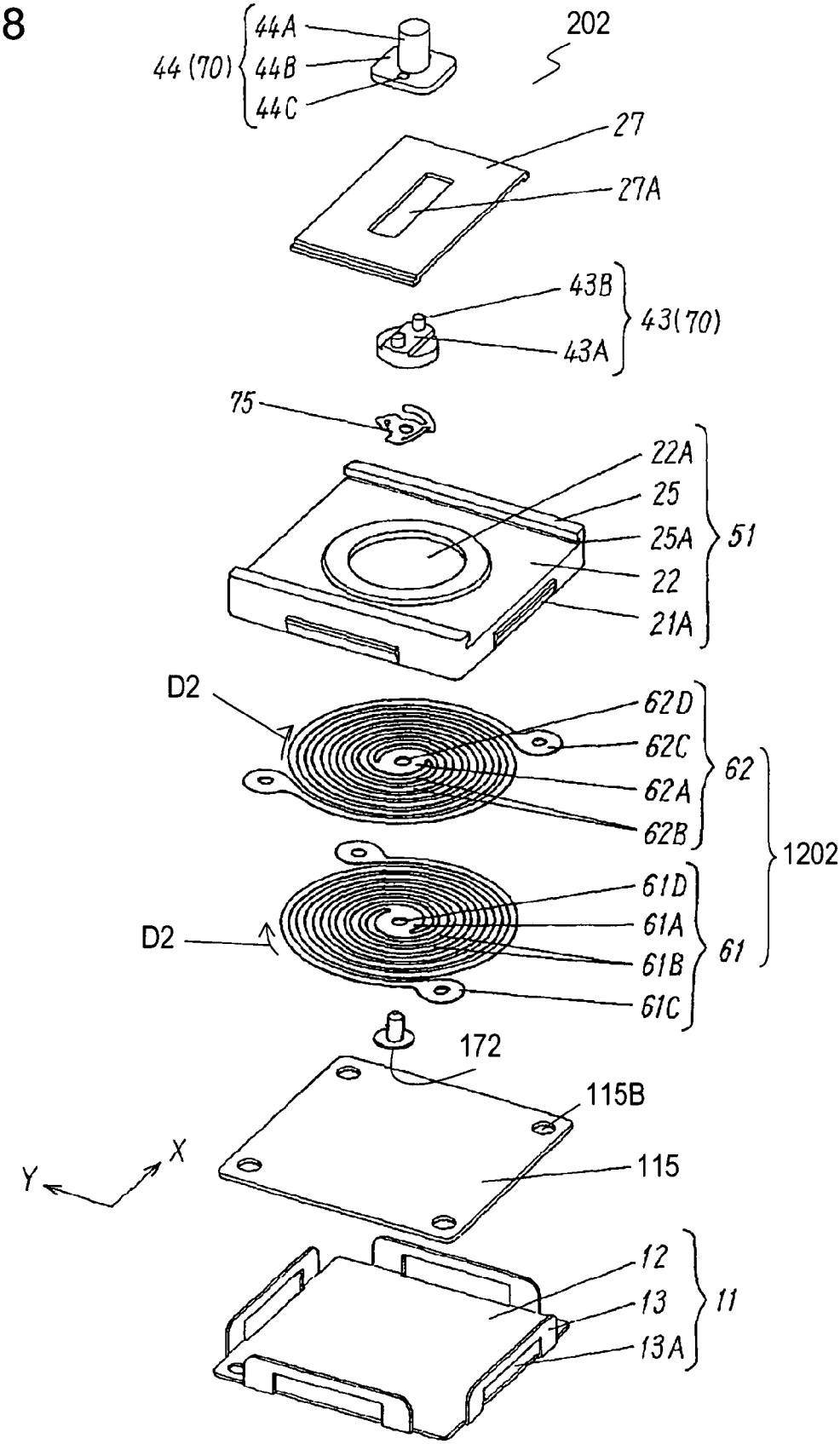
FIG. 8 is an exploded perspective view of another input device according to Embodiment 2.
Figure 9:
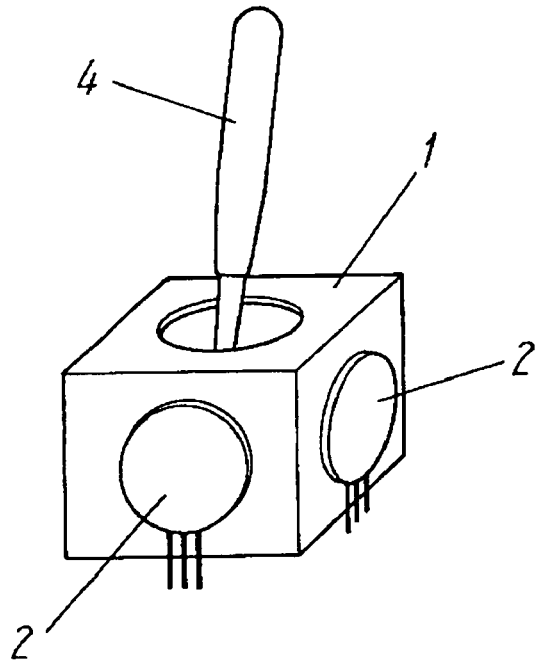
FIG. 9 is a perspective view of a conventional input device.
Figure 10:
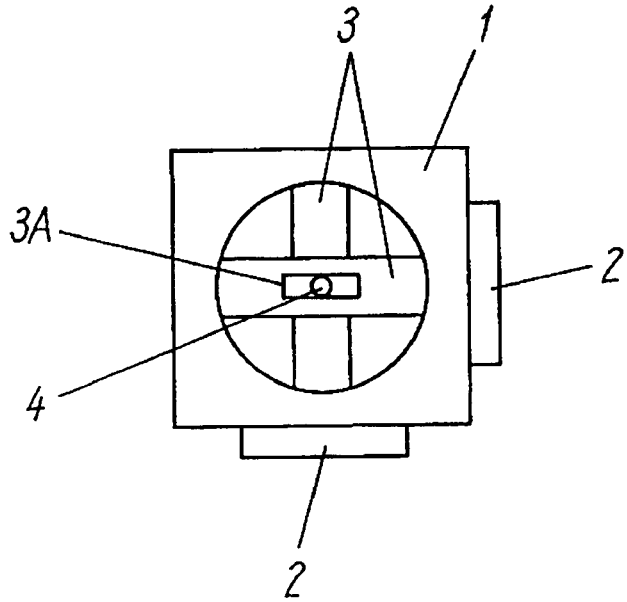
FIG. 10 is a top view of the conventional input device.

FIG. 8 is an exploded perspective view of another input device 202 according to Embodiment 2. Input device 202 includes, instead of coordinate detector 15 of the touch panel shown in FIG. 6, a combination of coordinate detector 115 including a magnetic plate for generating magnetic fields different according to plane positions and magnetic detector 172 provided on lower member 71 of actuator 70 to face coordinate detector 115. The other arrangement of input device 202 is identical to that of input device 201. Magnetic detector 172 detects the plane position of actuator 70 without touching coordinate detector 115, hence increasing the operating life of coordinate detector 115 and input device 202.

What is claimed is:

1. A neutral position returning mechanism comprising:

an actuator;

two spring members including a plurality of elastic extensions each having a spiral shape, said plurality of elastic extensions each extending spirally in a predetermined direction from said actuator as a center of each spiral shape, each of said plurality of elastic extensions extending from said actuator at angular intervals equal to each other with respect to said center; and a case holding said spring member as to apply a stress to said plurality of elastic extensions, wherein one spring member includes a first straight portion, the other spring member includes a second straight portion, each elastic extension of the one spring member extending from opposite ends of the first straight portion, each elastic extension of the other spring member extending from opposite ends of the second straight portion.

2. The neutral position returning mechanism according to claim 1, wherein the plurality of elastic extensions extend on a predetermined surface, and said predetermined surface is a plane.

3. The neutral position returning mechanism according to claim 1, wherein the plurality of elastic extensions extend on a predetermined surface, and said predetermined surface is a concave surface having a bottom at said center.

4. The neutral position returning mechanism according to claim 1, wherein the plurality of elastic extensions includes a first pair of elastic extensions offset by one hundred and eighty degrees from each other.

5. The neutral position returning mechanism according to claim 4, wherein the plurality of elastic extensions includes a second pair of elastic extensions offset by one hundred and eighty degrees from each other and each of the second pair of elastic extensions are offset by ninety degrees from each of the first pair of elastic extensions.

6. The neutral position returning mechanism according to claim 1, wherein the first straight portion is orthogonal to the second straight portion.

7. The neutral position returning mechanism according to claim 1, wherein the two spring members including the plurality of elastic extensions, the first straight portion, and the second straight portion are made of linear strip strings.

8. An input device comprising:

a neutral position returning mechanism including an actuator, two spring members including a plurality of elastic extensions each having a spiral shape, said plurality of elastic extensions each extending spirally in a predetermined direction from said actuator as a center of each spiral shape, each of said plurality of elastic extensions extending from said actuator at angular intervals equal to each other with respect to said center, and a case holding said spring member as to apply a stress to said plurality of elastic extensions; and a coordinate detector for detecting a position of said actuator, wherein one spring member includes a first straight portion, the other spring member includes a second straight portion, each elastic extension of the one spring member extending from opposite ends of the first straight portion, each elastic extension of the other spring member extending from opposite ends of the second straight portion.

9. The input device according to claim 8, wherein the plurality of elastic extensions extend on a predetermined surface, and said predetermined surface is a plane.

10. The input device according to claim 8, wherein the plurality of elastic extensions extend on a predetermined surface, and said predetermined surface is a concave surface having a bottom at said center.

11. The input device according to claim 8, wherein said coordinate detector is accommodated in said case.

12. The input device according to claim 8, wherein said coordinate detector comprises a touch panel activated by said actuator pressing said touch panel.

13. The input device according to claim 8, further comprising a magnetic detector provided at said actuator.

14. The input device according to claim 8, wherein the first straight portion is orthogonal to the second straight portion.

15. The input device according to claim 8, wherein the two spring members including the plurality of elastic extensions, the first straight portion, and the second straight portion are made of linear strip strings.

* * * * *